United States Patent [19]

Greenspan

[11] 4,299,394

[45] Nov. 10, 1981

[54] WHIRLING TOY AND WHIRLING TOY GAME

[76] Inventor: Myron Greenspan, 154 Girard St., Brooklyn, N.Y. 11235

[21] Appl. No.: 120,654

[22] Filed: Feb. 11, 1980

[51] Int. Cl.[3] ..... A63B 67/00; A63H 5/00

[52] U.S. Cl. ..... 273/348; 273/411; 273/414; 273/428; 46/52

[58] Field of Search ..... 273/58 C, 58 E, 398, 273/409, 411, 414, 415, 417, 428, 348; 272/106; 46/51, 52, 78, 80

[56] References Cited

U.S. PATENT DOCUMENTS

| | | | |
|---|---|---|---|
| 1,502,058 | 7/1924 | Quin | 273/58 C |
| 1,670,810 | 5/1928 | Humphreys | 273/58 C |
| 2,040,522 | 5/1936 | Marx | 273/58 C |
| 2,836,930 | 6/1958 | Ragazzo et al. | 46/52 |
| 3,082,571 | 3/1963 | Lewis | 46/51 |
| 3,554,551 | 1/1971 | Apiki | 273/411 |
| 3,837,650 | 9/1974 | Haney | 273/415 |
| 4,084,813 | 4/1978 | Washnock et al. | 272/106 |
| 4,088,319 | 5/1978 | Clarke | 273/58 E X |

FOREIGN PATENT DOCUMENTS

| | | | |
|---|---|---|---|
| 13092 | of 1889 | United Kingdom | 46/52 |

*Primary Examiner*—Anton O. Oechsle

[57] ABSTRACT

A whirling toy includes a weighted object such as a small bag filled with sand attached to one end of a string. Advantageously, streamers or other means are used to stabilize the toy while it is whirled prior to release into an upward trajectory. A target pattern or tape measure is used to determine the distance of the toy, after it has fallen to the ground, from the point of release. The toy may optionally be provided with means for producing an audible sound when the whirling toy velocity reaches a preselected threshold value. Such audible sound assures, if the toy is played competitively between two or more players, that all players have the same advantage since they all release the toy when it produces the audible sound and, therefore, reaches the preselected threshold velocity.

14 Claims, 7 Drawing Figures

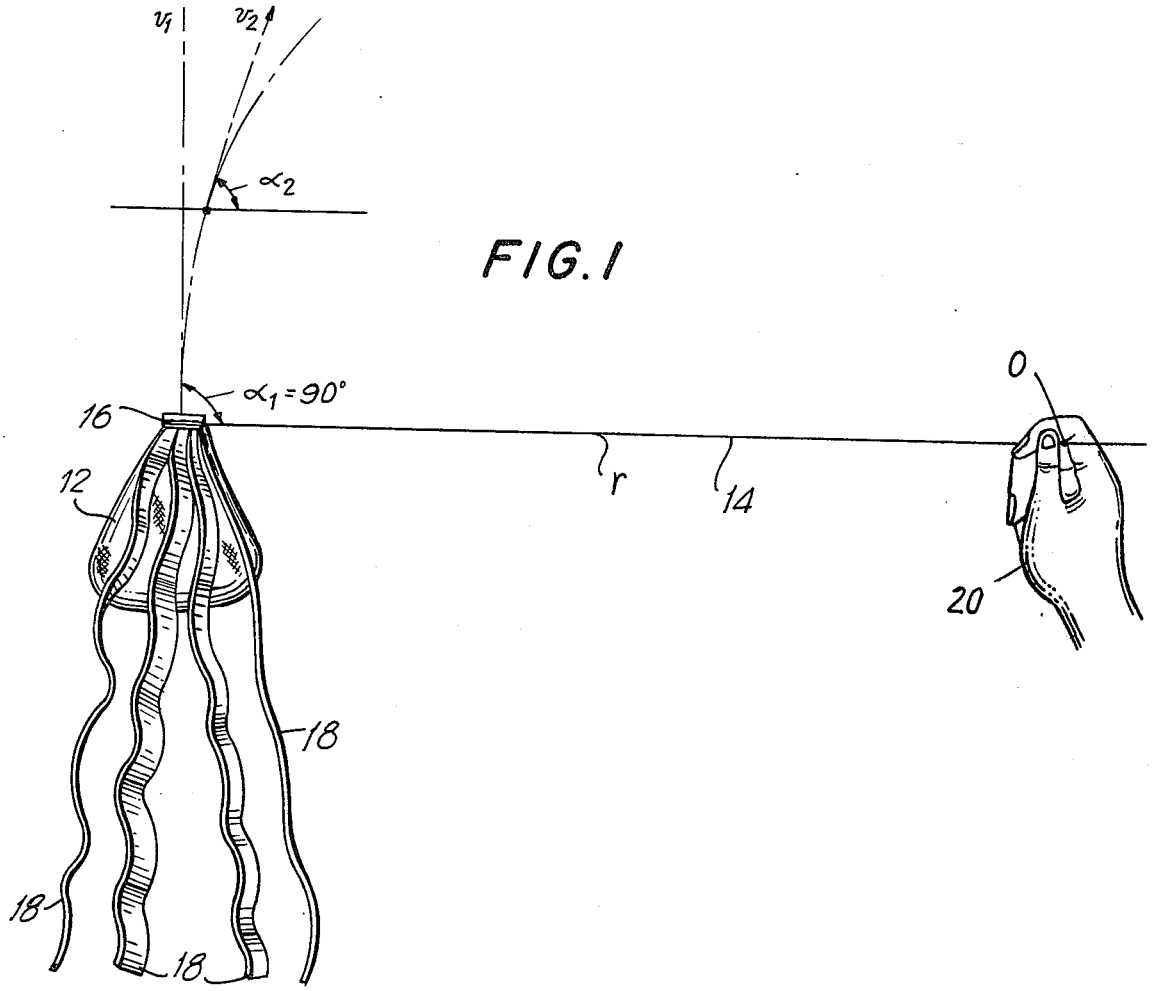
FIG. 1
FIG. 2
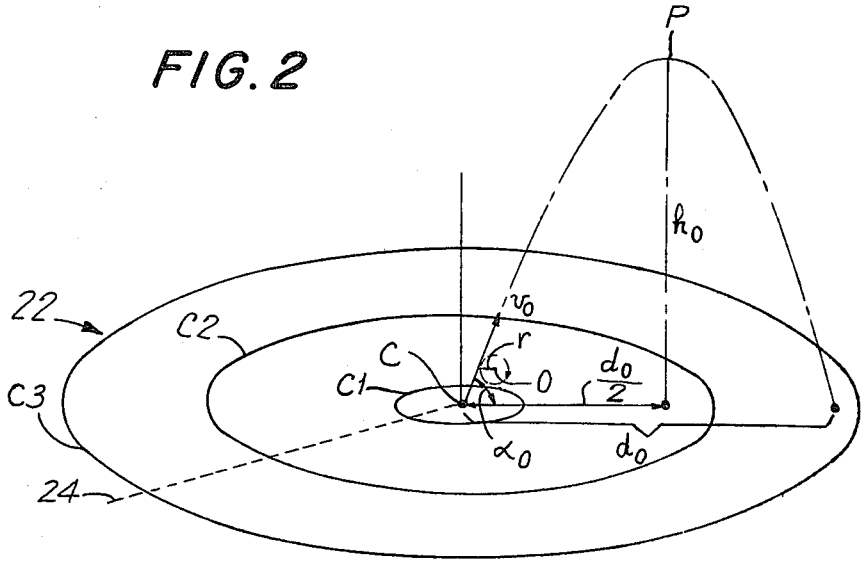

FIG.4
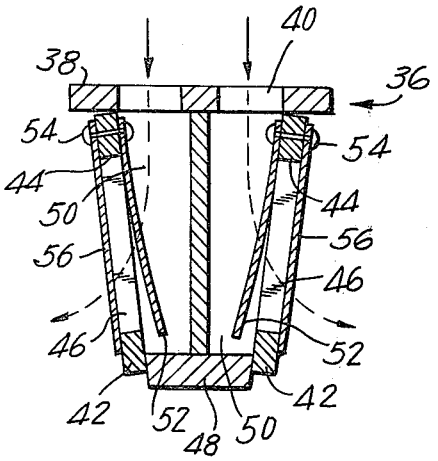
FIG.3
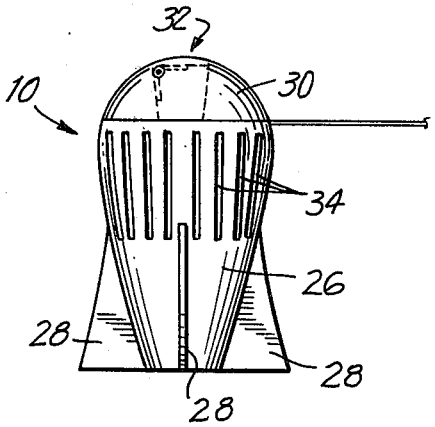
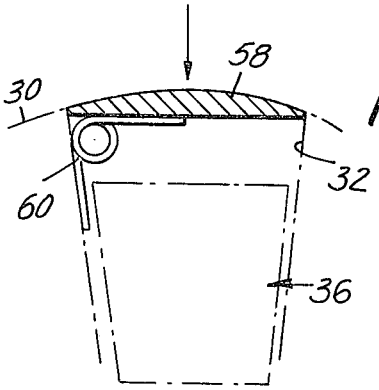
FIG.5
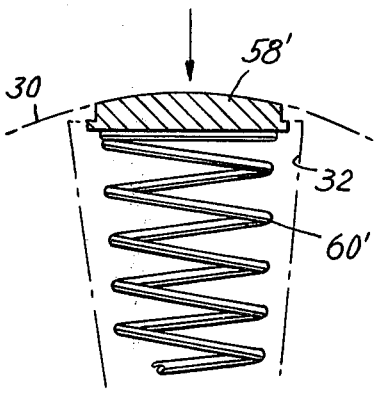
FIG.6
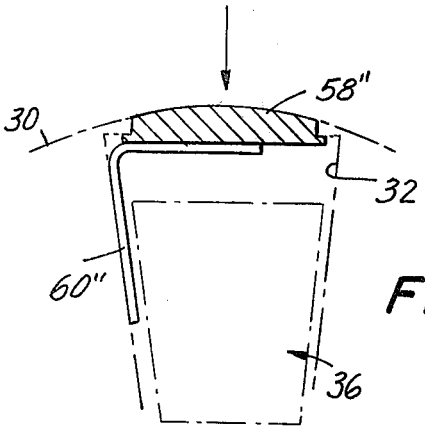
FIG.7

WHIRLING TOY AND WHIRLING TOY GAME

BACKGROUND OF THE INVENTION

The present invention generally relates to toys, and more particularly to a whirling toy which can be played alone or competitively between two or more players.

An object of the present invention is to provide a whirling toy which is simple in construction and economical to manufacture.

It is another object of the present invention to provide a whirling toy which can be played alone or competitively between two or more players.

It is still another object of the present invention to provide a whirling toy which can be tailored to provide long periods of recreation for young children, while it can also be played with high degrees of sophistication requiring great coordination, dexterity, and knowledge of physical principles.

It is yet another object of the present invention to provide a whirling toy which includes streamers or the like for stabilizing the whirling toy during its rotary movements prior to release into its trajectory.

It is a further object of the present invention to provide a whirling toy which includes sound producing means for assuring that when the toy is played competitively all the players have the same advantage.

It is still a further object of the present invention to provide a whirling toy which is easy and convenient to play, and which enables the player to become proficient with practice.

It is yet a further object of the present invention to provide a whirling device of the type generally described above which is rugged in construction.

SUMMARY OF THE INVENTION

In order to achieve to above objects, as well as others which will become apparent hereafter, a whirling toy in accordance with the present invention comprises a weighted object. An elongate member is provided having a predetermined length and attached at one end thereof to said weighted object. In this manner, holding said elongate member at the other end thereof permits whirling of said weighted object in a generally vertical plane about a radius approximately equal to said predetermined length and permits release of said weighted object in a generally upward direction. Indication means are advantageously provided for determining the distance of said weighted object after its return to the ground from the point of original release. The weighted object may include sound producing means associated therewith which is responsive to the flow of air proximate to said weighted object while the same is being whirled in the air. In this manner, said weighted object produces an audible sound during whirling.

BRIEF DESCRIPTION OF THE DRAWINGS

A more complete appreciation of the invention and many of the attendant advantages thereof will be readily obtained by reference to the following detailed description when considered in connection with the accompanying drawings wherein:

FIG. 1 is a side elevational view of a whirling toy in accordance with the present invention, as shown at a moment of its rotary motion in a vertical plane when the object and the string by which it is held by the user are in a horizontal plane with the hand of the user, this figure showing two possible trajectories for the weighted object when the same is released at two different moments of time during its whirling motion;

FIG. 2 is a schematic representation of a possible trajectory of the weighted object when released substantially at the center of a target pattern, showing the position where the object lands when it falls to the ground;

FIG. 3 illustrates an alternate embodiment of the weighted object of the whirling toy which includes means for producing an audible sound when the whirling velocity reaches a predetermined threshold value;

FIG. 4 is an enlarged cross-sectional view of a sound-producing means of the type which can be used in the weighted object shown in FIG. 3;

FIG. 5 illustrates the details of a threshold velocity detecting means used in conjunction with the whirling toy shown in FIG. 3, the velocity sensing element being in the nature of a cover biased by a coil spring;

FIG. 6 is similar to FIG. 5, except that the cover is biased by a helical spring; and FIG. 7 is similar to FIGS. 5 and 6, except that the cover is biased by a leaf spring.

DETAILED DESCRIPTION

Referring now to the figures, in which the same reference numerals are used to designate the identical or similar parts throughout, and first referring to FIG. 1, the whirling toy in accordance with the present invention is generally identified by the reference numeral 10.

The whirling toy 10 includes a weighted object 12. The actual weight or shape of the weighted object 12 is not critical. However, for aerodynamic reasons, the weighted object should preferably be streamlined, for reasons which will become apparent hereafter.

An elongate member, which is in the nature of a spring 14, is attached at one end thereof to the weighted object 12. For this purpose, any string connecting means 16 can be used. In order to stabilize the weighted object during whirling at high speeds, the weighted object is advantageously provided with at least one streamer 18 attached to the weighted object substantially as shown. In this manner, the streamers generally follow the path of the weighted object along the path of travel thereof.

The weighted object may comprise, for example, a small sack filled with sand. However, as noted, this is not critical and any suitable weighted object can be used.

In use, the user 20 grips the other end of the string 14 at a point O and whirls the object along a circular path in a horizontal plane. The weighted object 12 thus whirls about a radius approximately equal to a predetermined length r of the string 14. Release of the weighted object, as will be discussed in connection with FIG. 2, permits the weighted object to be cast in a generally upward direction, at a velocity which is a function of the length r and the whirling speed.

Referring to FIG. 2, there is shown a target pattern 22 comprising concentric circles C1, C2 and C3 of the type normally used in target practice or shooting in conjunction with other target games. In using the whirling toy, the user or player stands in the center of the target pattern 22 at the point designated by "C". The user whirls the weighted object 12 as discussed above and suggested in FIG. 1 about a radius r at the point O. Preferably, the user whirls the weighted object 12 such that the point O coincides as closely as possible to the center C of the target pattern 22.

Referring to FIGS. 1 and 2, it will be evident that when the weighted object is released at the moment when the object and its string 14 are in a common horizontal plane with the hand of the user 20, the weighted object 12 will continue to move in a substantially vertical direction at an angle $\alpha_1$ approximately equal to 90° with the horizontal. The velocity $v_1$ is a function of how rapidly the weighted object is rotated or the angular velocity $\omega$ and the length of the string r since $v=\omega r$. Absent wind velocities, the weighted object will climb to a predetermined height which is a function of $v_1$ and return along its path of ascent to land at or very near to the point C of original release. However, releasing the weighted object 12 at the aforementioned ideal moment requires considerable coordination and timing which, however, can be developed with practice.

Referring to FIG. 2, it will be seen that when the weighted object is whirled about the point O and released at an angle $\alpha_2$, it rises along a trajectory to a point P which is at a maximum height $h_o$ above the ground. Once it reaches this maximum height, the object begins to descent along the path shown. Under these circumstances, the maximum height is given by the following expression:

$$\max h = \frac{V_o^2 \sin^2\alpha}{2g}, \quad (1)$$

where $v_o$ is the initial velocity, $\alpha$ is the angle of release with respect to the horizontal plane, and g represents the effect of gravity. An important expression for purposes of the game of the present invention, as will be more fully apparent hereafter, is the expression for the horizontal range R, shown as $d_o$ in FIG. 2. This is the distance travelled by the object along the horizontal direction from the point of release at C when the object is propelled upwardly at an angle other than 90° to the horizontal [at$\alpha$=90°, sin $2\alpha=0$ so that R=0], in the absence of wind disturbances. This expression is:

$$R = \frac{v_o^2 \sin 2\alpha}{g} \quad (2)$$

As will be seen, therefore, the horizontal range or displacement along the ground is proportional to the square of the initial velocity as well as proportional to the sine of twice the angle $\alpha$. Stated otherwise, for the same angle $\alpha$, the greater the initial velocity or the more rapidly the object is whirled, the greater will be the range. On the other hand, for the same initial velocities, the range increases as the object is cast at angles which deviate more from the vertical direction. Based on this last expression (2), if the object is cast precisely in the vertical direction so that $\alpha=90°$, it doesn't much matter what the initial velocity is since the object will simply return along the path of rise and fall at the point of release. However, if $\alpha$ is any angle other than 90°, there are two factors, as aforementioned, which must be considered in using the toy, namely the initial velocity and the angle of release.

Since it is very rare when there are no wind currents at all, more advanced players may also wish to take into account the effects of wind velocity. Since linear displacement along the horizontal direction is simply a function of the wind velocity as well as the time that the object is in the air, the errors attributed to wind will be minimized when the time that the object is in the air is also minimized. However, as will be discussed hereafter, a lower limit may be set on the time by requiring that the object be cast into the air at a minimum initial velocity. This will also therefore result in the object rising and falling through the air during a predetermined time interval. In this connection, it may also be noted that the effects of wind velocity may either aid or aggravate initial errors during release of the object. Clearly, referring to FIG. 2, if the object is cast at an angle $\alpha_o$ and would normally land a distance $d_o$ from the initial point C, in the absence of wind velocity, the distance $d_o$ would be increased in the presence of wind moving from left to right as viewed in FIG. 2, while the distance $d_o$ would be decreased in the presence of a wind movement from right to left as viewed in FIG. 2.

As suggested, the object of the game is to whirl the object 12 at a relatively high speed and release the same in a vertical direction. In most instances, especially with those untrained, the object will not move along a vertical direction as represented by the velocity $v_1$ in FIG. 1, but will be cast off at a slight angle from the vertical, as suggested by the velocity $v_2$. Under these circumstances, the object will not fall back to the initial starting point C in FIG. 2, but will be propelled along a horizontal range or distance which is a function of factors or parameters which can be controlled by the player.

Once the object falls to the ground, it can be measured in relation to the starting point C either by the use of a target pattern 22 or by simply using a measuring device of any convenient type, such as a tape measure 24.

When playing alone, of course, the player can simply practice and cast the object at any initial velocity $v_o$ that he or she wishes. However, because the horizontal range is a function of the square of the initial velocity, it would clearly give a player in competition an advantage if he could cast his object at a smaller initial velocity. To assure that all players have the same advantage, and that all the objects cast in competition have at least a minimum initial velocity $V_o$, the weighted object 12 is advantageously provided with means for producing an audible sound upon attaining the minimum velocity. The specific means for achieving or producing such an audible signal is not critical for purposes of the present invention, and any such means can be used which will provide an audible signal when a player whirls the object 12 at a fast enough speed.

Referring to FIG. 3, there is shown a modified embodiment or construction of the weighted object and is designated by the reference numeral 10'. While the weighted body, as suggested, can comprise any suitable mass such as a small bag filled with sand, the embodiment of FIG. 3 is illustrative of a construction suitable for producing the audible sounds as proposed above. Thus, the weighted object 10' has a body 26 provided at the trailing end thereof with a plurality of fins 28 which serve as the stabilizing means. Of course, any other stabilizing means may be utilized, such as the streamers 18 of FIG. 1.

The weighted object 10' is provided at the leading or other end thereof with a dome or head portion 30 which is shown generally spherically shaped and is advantageously made of an elastomeric soft material. In this way, if the weighted object is inadvertently propelled towards a bystander or if the weighted object hits the bystander as it descents from its trajectory, the injury to the bystander will be avoided.

The dome 30 is provided with a central opening or air inlet 32 which is adapted to admit air during forward movement of the weighted object. A plurality of circumferentially spaced air outlet slots or vents 34 are provided for allowing the air which enters into the air opening or inlet 32 to escape. In this manner, there is permitted a flow of air through the body of the weighted object 10', and generally, the faster that the weighted object 10' is whirled, the greater is the speed of air movement through the internal openings and cavities in the weighted object. Therefore, providing a sound producing means within the weighted object 10' which responds to the passage of air proximate thereto produces an audible sound.

Referring to FIG. 4, there is shown, by way of example only, one type of sound producing means which can be used in conjunction with the weighted object 10' of FIG. 3. The sound producing means, which is generally designated in FIG. 4 by the reference numeral 36, is in the nature of a reed device of the type which is used, for example, in accordions. The sound producing means 36 includes a sound board 38 which includes air inlet openings or air holes 40. Provided laterally of the sound board 38 are one or more slotted plates 42 which are provided with slots 44 to produce air outlet openings 46. At the far end, there is provided a sound post 48 which forces the air entering through the air inlet openings 40 to exit through the air outlet openings 46, as indicated by the arrows in FIG. 4. The air, between the time that it enters through the air inlet openings 40 and leaves through the air outlet openings 46 moves through air passages 50 in which there are located reeds 52 associated with each slot 44 or air outlet opening 46. The reeds may be screwed or riveted over the slots 44 by means of connecting means 54. The reeds themselves may be made of watch-spring steel or brass, and are permitted to vibrate freely in their slots so that they are at times referred to as "free reeds". To minimize air consumption, the slots may be closed by flexible flaps or leather members 56 which are formed so as to normally cover or close the slots 44, and only open in response to air pressures of predetermined value. In this sense, the members 56 serve as velocity detectors which open the slots 44 when the weighted object 10' reaches a predetermined speed so as to enable the reeds 52 to become actuated and emit an audible sound. Naturally, by controlling the dimensions and flexibility of the members 56, the threshold velocity may be selected at which the audible sounds will be emitted.

When the sound producing means 36 shown in FIG. 4 is placed within the weighted object 10' of FIG. 3, the air entering through the central inlet opening 32 is admitted through the air inlet openings 40 of the sound producing means, and the air which leaves the air outlets 46 of the sound producing means is permitted to escape through the air outlet slots 34 in the body 26.

Another possible approach for controlling the threshold velocity at which a sound signal is emitted is to provide suitable covers for the central air inlet opening 32 of the weighted object 10', and have these covers open at the selected velocities so as to permit air passage to pass the reeds. Below the predetermined velocities, the covers remain closed and no air is emitted into the sound producing means. Thus, in FIG. 5, the dome 30 is shown to house a sound producing means 36 of the type shown in FIG. 4 (shown in phantom outline), with the central opening 32 being normally closed by cover 58. The cover is supported by a resilient biasing spring 60. When the whirling toy reaches the desired velocity, sufficient air pressure upon the cover 58, as represented by the arrow in FIG. 5, is sufficient to overcome the restoring forces of the spring 60, and the cover 58 is deflected downwardly or inwardly into the dome 30. At such time, air is permitted to flow through the sound producing means 36 with the resultant emission of audible signals, as described above.

In FIG. 6, a variant of the embodiment of FIG. 5 is shown, wherein instead of a coil spring as shown in FIG. 5, the cover 58' is supported by a helical spring 60' which, likewise, deflects inwardly in response to sufficient air pressures acting on the cover. In FIG. 7, the springs shown in FIGS. 5 and 6 are replaced by a leaf-type spring 60'' which supports the cover 58''.

The operation of the embodiment shown in FIGS. 5, 6 and 7 are generally the same as described above in connection with FIGS. 3 and 4. However, where a separate cover is provided for the central opening 32 which responds to predetermined air pressures and, therefore velocities, it may be possible to dispense with the velocity deflectors 56 since both the deflectors 56 and the covers serve essentially the same function. Both regulate the amount of air which is permitted to flow past the reeds and, to that extent, prevent the generation of audible signals until such time that the whirling toy is rotated at a high enough speed and, therefore, has attained a sufficiently linear velocity.

As will be evident from the above description, the whirling toy 10 can be used alone for entertainment or amusement by even very young children, while it can be used by older children and adults both alone or in competition with others in what amounts to a game requiring great skill, including coordination and timing, as well as the familiarity with the basic laws of physics. When used competitively, means are advantageously provided for accurately measuring the performance of each player and, therefore, comparing the performances between players. Such measuring means may consist of any suitable device, two such means being shown in FIG. 2 to include a target pattern and a simple measure. Further, and particularly in competition, since performance is proportional to the speed at which the toy is whirled and released into its trajectory, means are advantageously provided for assuring that each person competing releases the toy at a minimum velocity as above noted. This assures that all the players have an equal advantage and, in a sense, it assures that the initial velocities of the whirling toys of all the players is substantially constant. Accordingly, based on the above equation for horizontal range R, once the initial velocities are constant, the only variable that remains is the angle $\alpha$ so that the more vertically a player propels his toy, the closer it will return to its initial point of departure or closer to the point C in FIG. 2. The contest, then, is reduced to the ability of the players to release their whirling toys just at the right moment when the toy is travelling in a vertical direction.

In addition to serving as stabilizers, the streamers 18 can be decorative and made out of multi-colored strips of paper or plastic. When the toy is propelled upwardly or descends, the streamers give the appearance of a trail of fire or smoke, such as may be associated with a rocket or falling meteor.

The length r of the string 14 is not critical, as above suggested. However, since the linear velocity v is a function of the product of the whirling speed or angular velocity $\omega$ and the length r, it is clear that for the same rotational speed, the greater the string length r, the greater is the velocity v. In competition, therefore, all players should use the same string lengths, except that different lengths can be used if handicaps are desired. Of course, where the toys are to be used by young children, the string lengths may have to be shorter since a toy 10 whirled in a vertical plane by a short shild may otherwise hit the ground.

While the principles of the present invention have been described in terms of specific embodiments, clearly, the invention is not intended to be limited to the presently preferred embodiments described. A person skilled in the art may modify or change the constructions or applications from the teachings of the principles of the present invention without departing from the spirit and the scope thereof.

What is claimed is:

1. A whirling toy game comprising means defining a player location; a weighted object; an elongate member having a predetermined length and attached at one end thereof to said weighted object, whereby holding said elongate member at the other end thereof permits whirling of said weighted object in a generally vertical plane about a radius approximately equal to said predetermined length and permits release of said weighted object in a generally upward direction; and omnidirectional indication means for determining the distance of said weighted object after its return to the ground anywhere in a 360° circle with respect to said player location defining means.

2. A whirling toy as defined in claim 1, wherein said weighted object comprises a sack filled with sand.

3. A whirling toy as defined in claim 1, wherein said elongate member comprises a string.

4. A whirling toy as defined in claim 1, further comprising at least one streamer attached to said weighted object, whereby said at least one streamer generally follows said weighted object along the path of travel thereof.

5. A whirling toy as defined in claim 1, wherein said weighted object includes sound producing means responsive to the flow of air proximate to said weighted object while the same is being whirled in the air, whereby said weighted object produces an audible sound during whirling.

6. A whirling toy as defined in claim 5, wherein said sound producing means comprises a reed element mounted on said weighted object.

7. A whirling toy as defined in claim 1, wherein said indicating means comprises a target pattern positionable on the ground.

8. A whirling toy as defined in claim 1, wherein said indicating means comprises an elongate measure; and securing means for securing one end of said measure to the point on the ground where the whirling toy is originally released to define a circular target area having a radius equal to the length of said elongate measure, whereby said measure can be moved to any point within said target area to measure the distance of said point from the point of original release.

9. A whirling toy comprising a weighted object; an elongate member having a predetermined length and attached at one end thereof to said weighted object, whereby holding said elongate member at the other end thereof permits whirling of said weighted object about a radius approximately equal to said predetermined length; sound producing means associated with said weighted object responsive to the flow of air proximate to said weighted object while the same is being whirled in the air; and velocity threshold detection means for normally disabling said sound producing means and for enabling said sound producing means only when said weighted object moves at a velocity at least equal to a predetermined value, whereby said weighted object produces an audible sound only when whirled at or above said velocity.

10. A whirling toy as defined in claim 9, further comprising stabilizing means for maintaining the orientation of said weighted object in a position which optimizes air flow in relation to said sound producing means during whirling and assures reliable and continuous generation of an audible signal during whirling.

11. A whirling toy as defined in claim 10, wherein said stabilizing means comprises at least one streamer attached to weighted object, whereby said at least one streamer generally follows said weighted object along the path of travel thereof.

12. A whirling toy as defined in claim 10, wherein said stabilizing means comprises fins on said weighted object.

13. A whirling toy as defined in claim 9, wherein said sound producing means includes air inlet and air outlet openings and a sound producing element between said openings for generating an audible sound in response to passage of air therebetween, said velocity threshold detection means including air blockage means for blocking at least one of said openings when said weighted object moves at a velocity below said predetermined value.

14. A whirling toy as defined in claim 13, wherein said air blockage means comprises a resiliently biased member normally blocking said at least one of said openings and arranged to deflect to uncover the same in response to a predetermined air pressure which results at said predetermined velocity.

* * * * *